US008563865B2

(12) United States Patent
Nair

(10) Patent No.: US 8,563,865 B2
(45) Date of Patent: Oct. 22, 2013

(54) FLAT WIRE SHIELDED PAIR AND CABLE

(76) Inventor: Rajendran Nair, Gilbert, AZ (US)

( * ) Notice: Subject to any disclaimer, the term of this patent is extended or adjusted under 35 U.S.C. 154(b) by 40 days.

(21) Appl. No.: 13/200,974

(22) Filed: Oct. 6, 2011

(65) Prior Publication Data

US 2012/0043107 A1 Feb. 23, 2012

Related U.S. Application Data

(63) Continuation-in-part of application No. 11/713,778, filed on May 3, 2007, now Pat. No. 7,449,639, and a continuation-in-part of application No. 11/654,168, filed on Jan. 18, 2007, now abandoned.

(51) Int. Cl.
*H01B 11/00* (2006.01)
*H01B 7/18* (2006.01)

(52) U.S. Cl.
USPC ..... 174/113 R; 174/117 FF

(58) Field of Classification Search
USPC ..... 174/117 FF, 113 R
See application file for complete search history.

(56) References Cited

U.S. PATENT DOCUMENTS

| | | | | |
|---|---|---|---|---|
| 1,853,677 | A * | 4/1932 | Fischer | 174/32 |
| 6,005,193 | A * | 12/1999 | Markel | 174/117 FF |
| 6,225,563 | B1 * | 5/2001 | Poulsen | 174/117 FF |
| 6,340,795 | B1 * | 1/2002 | Caldwell | 174/117 FF |
| 7,449,639 | B2 * | 11/2008 | Nair | 174/113 R |
| 2006/0180339 | A1 * | 8/2006 | Huffman | 174/117 FF |
| 2008/0173464 | A1 * | 7/2008 | Nair | 174/117 FF |
| 2008/0173465 | A1 * | 7/2008 | Nair | 174/117 FF |

* cited by examiner

*Primary Examiner* — Chau Nguyen

(57) ABSTRACT

Novel shielded flat wire pair and cable implement flat, smooth conductors coated with insulation bonded together, providing rectangular cross-sections and equidistant, smooth surfaces for high frequency signal current flow. Flat wire pairs with conductive covers and symmetrically placed shield conductors in grooves between flat wires minimize intra-pair signal flow skew. Shielded flat wire pairs are placed within a cable assembly with adjacent wire pairs oriented orthogonally, minimizing crosstalk and rendering crosstalk common-mode. Such orientation of flat wire pairs is assisted by an internal separator, which may be electrically conductive and grounded providing enhanced pair to pair isolation. Presence of flat wire pairs and an internal separator in a cable positions additional single wires in the cable firmly against a grounded external shield, ensuring a predetermined impedance for these signal wires. Shielded flat wire pairs and cables of low metal content extend electrical signaling to the millimeter wave regimes.

20 Claims, 2 Drawing Sheets

Multichannel flat wire pair cable with co-axial separator

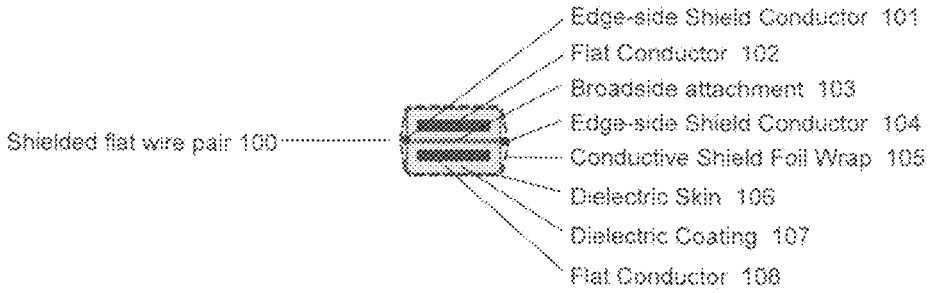
Fig. 1: Flat conductor shielded pair
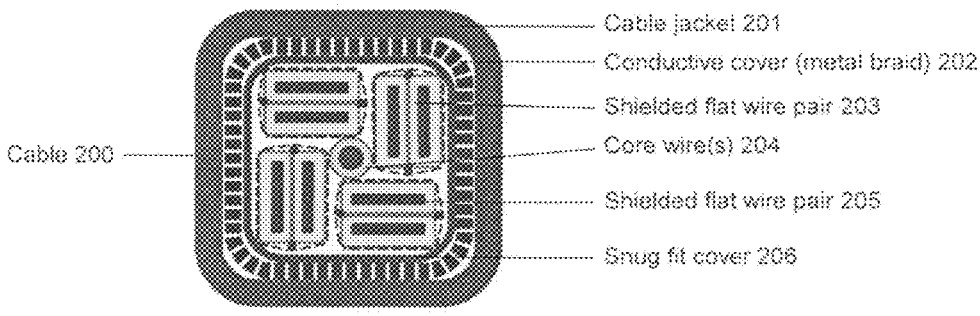
Fig. 2: Compact multichannel flat wire pair cable cross-section
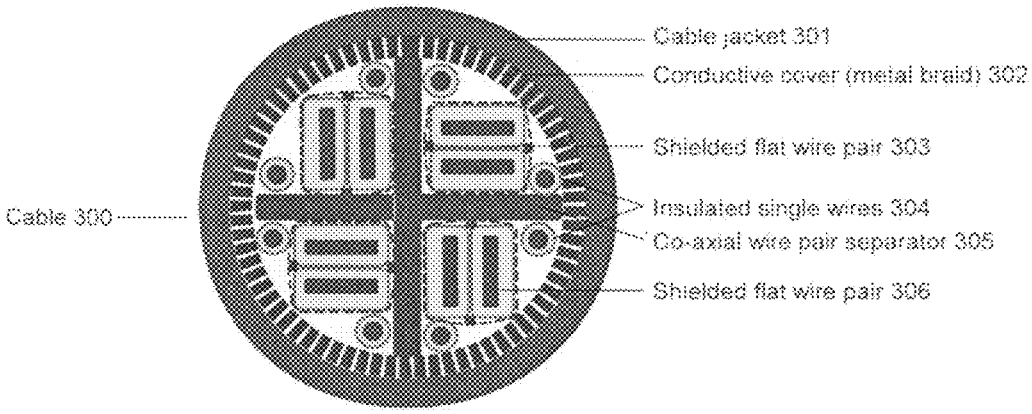
Fig. 3: Multichannel flat wire pair cable with co-axial separator

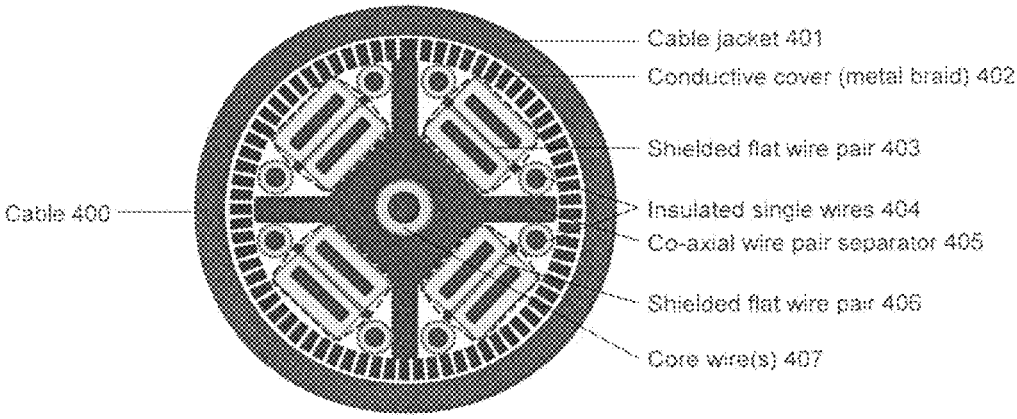
Fig. 4: Preferred multichannel flat wire pair cable with separator
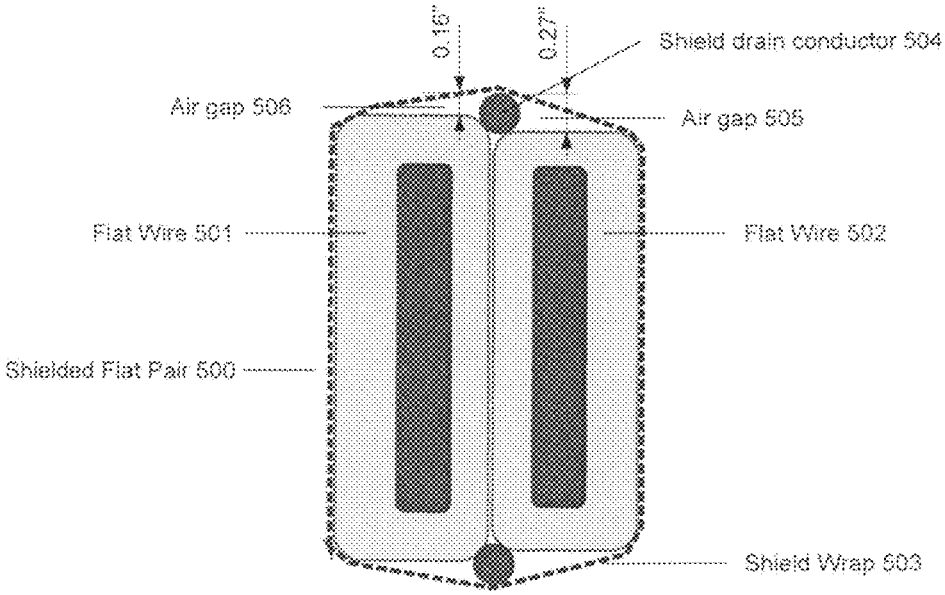
Fig. 5. Mismatched flat wires in a pair and invention shield impact

FLAT WIRE SHIELDED PAIR AND CABLE

RELATED DOCUMENTS

This application is a continuation in part (CIP) of U.S. utility patent application Ser. No. 11/654,168 filed Jan. 18, 2007, entitled "Shielded flat pair cable with integrated resonant filter compensation", and U.S. Pat. No. 7,449,639, filed Mar. 5, 2007, entitled "Shielded flat pair cable architecture", the specifications and claims of which are fully incorporated herein by reference.

TECHNICAL FIELD OF THE INVENTION

Embodiments of the invention relate to electronic wiring and cabling employed to conduct signals from point to point. Such embodiments fall under the category of wire based interconnect for high speed applications.

BACKGROUND & PRIOR ART

Prior art twisted wire pair [Ref. 2], employed in "balanced" or differential signaling addresses concerns of electromagnetic coupling such as crosstalk and electromagnetic interference (EMI) through wire pair design and shielding. Wire pair twist in particular, characterized by the "lay length" (length for one complete twist of the wire pair) of the pair, is helpful in ensuring that external noise coupled is, to the first order, the same in the two wires of the pair. Due to this property, "enhanced" cable categories employ very short lay lengths or tight twist, which also helps ensure that wires of the pair do not separate under mechanical stress induced, for example, by bending. Nevertheless, as discussed in U.S. patent application Ser. No. 11/654,168 and U.S. Pat. No. 7,449,639, wire pair twist results in other characteristics such as intra-pair skew, inter-pair skew, and mode conversion (differential signal to common-mode) along the length of the wire pair, which prove detrimental in high speed multimedia information transfer applications.

Mode conversion that results from intra-pair skew or individual wire impedance variations along the length of a twisted wire pair is particularly detrimental. The duration of differential signal transformed to common-mode leads to electromagnetic emissions from the wire pair, which may well couple into neighboring wire pairs carrying similar signals. Prior art therefore employs wire pair shielding, or a conductive cover around a wire pair that attenuates any electromagnetic radiation encountered. This shield typically takes the form of a conductive foil wrap around the twisted wire pair, and is reasonably effective (varying with radiating signal frequency) in absorbing wire-pair generated or external radiation. In order to ensure effectiveness of the shield, an uninsulated drain wire accompanies the twisted wire pair inside of the shield, making conductive contact with the shield. This drain wire helps ensure that the shield provides an effective, low-impedance return path for any common-mode or other stray signal generated from the twisted wire pair, thus containing the radiation from the twisted wire pair. Also, the shield responds to external radiation impinging upon the twisted wire pair, generating an opposing current that minimizes field transmission and signal coupling into the wires in the pair.

Nevertheless, shielding as implemented in twisted wire pair assemblies creates its own problems along the length of a cable. Shield foil wrapped around a twisted wire pair increases the capacitance of wires in the pair significantly, because each wire now has capacitance to the other and to the shield, therefore nearly doubling its capacitance. Because wire pair twist is done before foil is wrapped to form the shield, foil wrapped around the wire pair cannot be uniformly and equally wrapped around each individual wire of the pair. Therefore significant differences in the value of increased capacitance between wires of a pair is created by such shield, and as this difference in capacitance increases with increase in length of the wire pair, delay in the flow of signals through wires of the pair also changes, introducing significant additional intra-pair skew. In the extreme case of wire twist imbalance, where one wire is twisted around another that is more or less straight, most of the increase in capacitance is on the longer, twisted, outer wire adjacent to the shield wrap around the pair. Hence wire delay, which was significantly greater for the outer wire due to its greater length in this instance, increases even more for the outer wire due to additional capacitance to the foil shield. Shielding implemented in this manner (foil wrap), therefore, amplifies intra-pair skew due to wire length and dimensional differences in twisted wire pairs. A drain wire added to the mix also contributes to this problem since there is no definite method to ensure that the drain wire is equally coupled to both wires in a shielded twisted wire pair (STP) along the length of the STP. Hence, though addition of a foil wrap around a twisted wire pair (foil wrapped pair or FWP) and a drain wire inside this assembly contacting the foil provides a measure of shielding that minimizes coupling into or emissions from the wire pair, it adds to the original problem (intra-pair skew) creating emissions from the wire pair. More importantly, as discussed in application Ser. No. 11/654,168 and U.S. Pat. No. 7,449,639 [Ref. 3], intra-pair skew severely limits high-speed capability of wire pairs and cables over any significant length of cable, and foil wrap exacerbates this limitation. Similarly, impedance variations along the length of the FWP that existed before foil wrap, caused by dimensional or dielectric material variations, may be amplified by a foil shield around a twisted pair, degrading signal integrity further.

As the definition and quality of 2-D images and audio in multimedia transmission increases, and a migration to high definition (1080P, or 1920×1080 pixels, and 4K or 4096×3072 pixels/3-D displays, with 32 bits or higher per pixel for color, and at 60 up to 120 Hz screen refresh rates) proceeds, there is a clear need for significantly higher data rates (of as much as 48 Gbps) and correspondingly high frequencies of operation of links such those defined in the consumer electronics High Definition Multimedia Interface (HDMI), DisplayPort, and other similar links. In view of varied and significant limitations in prior art twisted wire pairs, their shielding, and cable assemblies, there is a need to improve upon wire pairs and cable architecture for such links.

INVENTION SUMMARY

The invention implements symmetric, uniform shielding for flat, smooth conducting wires coated with insulation that are bonded to each other. Flat wire pairs are symmetrically shielded through the use of conductive covers and symmetrically placed drain conductors minimizing intra-pair signal skew. Shielded flat wire pairs are placed within a cable assembly with wire pairs oriented orthogonally, adjacent to each other, minimizing crosstalk and rendering crosstalk common-mode, both by orientation and by the presence of shields and drain wires in the coupling path. Such orientation of flat wire pairs is assisted by an internal separator, which may be electrically conductive in an invention embodiment, providing enhanced isolation between flat wire pairs. A cable consisting of multiple flat wire pairs is also shielded in its external jacket that maintains cable structure, and may include additional wires within. The shape of flat wire pairs and an internal separator in the cable positions these additional wires firmly against the cable external shield, ensuring a well-defined return path for such individual wires and a predetermined value of impedance for these signal wires with respect to system ground to which a cable outer shield may be connected. Through these enhancements, the invention wire pair and cable provide very high data throughput rates, a high measure of isolation between wire pairs and individual wires, and isolation from other cables adjacent. Flat wire shielded pair cables are thus ideally suited to very high-speed data communication over a few meters, sufficient for consumer electronics devices.

BRIEF DESCRIPTION OF FIGURES

FIG. 1 illustrates the invention flat wire shielded pair cross section, showing drain conductors.

FIG. 2 is a compact cable invention embodiment employing flat wire shielded pairs.

FIG. 3 is a multichannel, multi-wire preferred cable invention embodiment with flat wire pairs.

FIG. 4 illustrates an alternate multichannel, multi-wire cable invention embodiment.

FIG. 5 illustrates invention drain wires and shield impact on flat wires of unequal dimensions.

DETAILED DESCRIPTION

An invention flat wire shielded pair (SFP) cross-section is illustrated in FIG. 1. With reference to FIG. 1, Shielded Flat Pair 100 comprises flat conductors 102 and 108, dielectric coating 107, dielectric skin 106, shield conductors 101 and 104, flat wire attachment region 103, and an outer conductive shield layer 105 that makes electrical contact with shield conductors 101 and 104.

Again, with reference to FIG. 1, flat conductor 108 covered by dielectric coating 107 and dielectric skin 106 form one flat wire of the pair, and another flat wire is formed by dielectric material around flat conductor 102. The dielectric material is preferably one with very low relative dielectric constant ($\in_r$), close to 1, such as polyethylene foamed uniformly with an inert gas such as Nitrogen. Dielectric skin may be formed on the surface of such coating simply by thermal treatment and additional plastic material, with such skin designed to prevent diffusion of oxidizing matter such as air or water into the flat wire. These two flat wires are abutted and mated at their "broad" side at attachment region 103, forming a flat wire pair, creating a groove in dielectric material on the "edge" side of the wire pair thus formed. Attachment of flat wires to each other is done in a thermally regulated, inert atmosphere, such as a process employed to create dielectric skin on each flat wire, to ensure homogeneous dielectric material between the two flat conductors in the wire pair. One skilled in the art will readily appreciate that rounded corners (in a cross-section) of rectangular wires, adjacent to each other in an attachment of such wires, will form a groove between such attached wire surfaces. A groove formed on an edge-side of a wire pair during attachment of flat wires to form a pair is ideally suited to position a shield drain wire for the pair. This is so because such groove is equidistant from both flat conductors 102 and 108 provided dielectric coating and skin formed on the two flat conductors 102 and 108 are of the same thickness. In such case, the distance to the groove from each flat conductor equals the distance from a rounded corner of the flat conductor to a correspondingly rounded adjacent corner of the dielectric coating and skin formed on this flat conductor, which distance may be roughly calculated as 1.414 times dielectric insulation thickness of either flat wire. With grooves on each edge side of the flat wire pair equidistant from flat conductors 102 and 108, uninsulated conductors of diameter larger than the groove depth, but small enough that the grooves assist in preventing any sideways movement of these conductors, placed within or along these grooves throughout the length of the flat wire pair, are identically coupled to both flat conductors 102 and 108. Additionally, because a groove on an edge-side of a flat wire pair is situated away from aligned flat conductors within wires of the pair, a conductor placed along such groove does not change the electromagnetic relationship between flat conductors of the pair appreciably. As opposed to prior art drain wire orientation within a twisted wire pair, where the placement and position of a drain wire with respect to either conductor in a twisted pair is indeterminate, the invention provides symmetrically positioned drain wires 101 and 104 coupled identically to flat conductors 102 and 108, on either side, within the invention shielded flat wire pair 100.

Further, with reference to FIG. 1, a conductive shield is formed around flat wires forming a pair with drain conductors positioned along grooves on either edge-side of the flat wire pair. Shield 105 of SFP 100 is wrapped tightly around the flat wire pair and edge-side drain conductors 101 and 104. A taut wrap for conductive shield 105 over a flat wire pair and drain conductors of matched dimensions provides not only mechanical robustness for assembly of attached flat wires and drain conductors within edge-side grooves, preventing any movement of drain conductors, but also provides a measure of capacitance and delay difference equalization between flat wires of shielded flat pair 100 as explained ahead. In one embodiment, Shield wrap 105 may be formed by metal foil wrapped spirally around flat wire pair and drain conductors assembly with each loop of foil overlapping the previous loop, thus forming a continuous metal foil shield around a flat wire pair. Such metal foil wrap may be terminated on drain conductors 101 and 104 at either end of the shielded flat pair assembly 100. In another embodiment, plastic wrap such as Mylar may be employed over metal foil wrap to provide a measure of isolation for shield wrap 105 of shielded flat pair 100 from any adjacent uninsulated conductors. In yet another embodiment, shield wrap 105 may be formed by plastic-metal foil wrap, such as Mylar-Aluminum, with the metal face of such foil on the inside of the wrap, contacting shield drain conductors 101 and 104, and the plastic face of the plastic-metal foil on the outside, providing insulation for shield wrap 105.

As taught in U.S. patent application Ser. No. 11/654,168, a practitioner of ordinary skill in the art will appreciate that flat conductors within a flat wire pair may be treated thermally or chemically on their broad, flat surfaces to reduce high-frequency resistance to signal flow caused by skin effect, where high frequency currents flow on the skin of conductors closest to current return pathways. In a coaxial cable with a central conductor and an outer shield, therefore, high frequency currents flow on the outer surface of the central conductor and the inner surface of the outer shield. The depth of penetration of such high frequency currents is of the order of a few micrometers for common conductor materials such as copper at gigahertz operating frequencies. Hence surface roughness on conductors of comparable root mean square value can severely impact conductor high frequency resistance, increasing it significantly, attenuating signals flowing through. In one embodiment of the invention shielded flat pair, therefore, the flat surfaces of conductors within the flat pair are plated with silver to a mirror finish of around 0.2 micrometers or lower surface roughness and insulated before any oxidation of silver coating the conductors occurs. In another embodiment, graphene nanoribbon layers of electrical conductivity an order of magnitude or more greater than copper are created upon surfaces of flat conductors facing each other in an invention flat wire pair to provide extremely low resistance pathways for high frequency currents. In yet another embodiment, the conductive shield wrapped around the flat wire pair in the invention shielded flat pair is plated with mirror finish oxidation-resistant metal (such as gold) to diminish the shield's high frequency resistance and improve its effectiveness.

FIG. 5 illustrates an impact of the invention drain wires and shield wrap on a flat wire pair with flat wires insulated with unequal thicknesses of dielectric coating and skin. With reference to FIG. 5, shielded flat pair 500 includes flat wire 501 and flat wire 502, where flat wire 502 has dielectric coating and skin that is lesser in dimension (thickness) as compared with dielectric coating and skin on flat wire 501. A practitioner with ordinary skill in the art may understandably first assume that flat wire 502 with lesser insulation thickness may see greater capacitance to the shield as compared with flat wire 501 in SFP 500, leading to greater signal delay in flat wire 502 with respect to that in flat wire 501, or increased intra-pair skew, as is often the case for prior art twisted wire pairs with foil wrap shielding. Upon careful inspection, it will be seen that this is not the case for invention drain wires and shield wrap architecture, and that the invention drain wires and shield wrap architecture minimizes differences in wire capacitance to the shield that may be caused by wire dimension variation. Due to increased overall capacitance in the presence of a shield around flat wires, it is seen in practice that shielded flat wire pair aspect ratio approaches 1:1 despite thin, flat conductors used for signal transmission. There are hence two distinct components to flat wire capacitance to the shield, a broadside capacitance component, and two edge-side capacitance components. One of ordinary skill in the art will appreciate that the broadside capacitance of flat wire 501 to shield wrap 503, to the first order, will be proportional to $((w+2t)/t)$, where w is the width of the flat conductor in flat wire 501 and t is the dielectric thickness of flat wire 501. Since insulation thickness t is lesser for flat wire 502, the broadside capacitance component of flat wire 502 to shield wrap 503 will be greater than that of flat wire 501 to the shield, due to the ratio (w/t). With w for the two flat wires remaining the same, the broadside capacitance of flat wire 502 to shield wrap 503 will be greater than the broadside capacitance of flat wire 501 to shield wrap 503, given lesser insulation thickness for flat wire 502. Similarly, edge-side capacitance components of wires 501 and 502 will be roughly proportional to $(\in_{eff}(h+2t)/t)$, where h is the flattened height of flat conductors, t the dielectric thickness, and $\in_{eff}$ the effective dielectric constant for edge-side regions of shielded flat wires that includes dielectric material and designed air gaps (whereas Ref. [1] attempts to eliminate air gaps) due to taut shield wrap over drain conductors. As seen in FIG. 5, one skilled in the art will readily appreciate that air gap 505 between flat wire 502 and shield wrap 503 is greater than air gap 506 between flat wire 501 and shield wrap 503 because of lesser insulation thickness of flat wire 502 and the presence of the drain conductor in the groove between flat wires 501 and 502. Since the relative dielectric permittivity for air is 1, and for typical dielectric material employed in wire pairs around 2, the effective dielectric constant in the edge-side region for flat wire 502 will be lesser than the effective dielectric constant for the edge-side for flat wire 501. With $h<t$, as is the case in practice, edge-side capacitance to shield is roughly proportional to $2\in_{eff}$, and is greater for flat wire 501 as compared with flat wire 502 which has lower insulation thickness. With shielded flat pair aspect ratios close to 1:1, higher broadside capacitance for flat wire 502 is compensated for by its lower, comparable edge-side capacitance, and hence any difference in capacitance between flat wires 501 and 502, to shield 503, is minimized by the invention drain wires and shield wrap architecture. Any increased capacitance in flat wire 502 due to reduced insulation thickness t is also compensated for in delay terms by decreased inductance with respect to shield wrap 503 given decreased insulation thickness that brings the shield wrap closer to the flat conductor within flat wire 502. For a regular structure such as a flat wire with a shield adjacent, inductance per unit length is calculated simply as $(\mu(t/w))$ where $\mu$ is magnetic permeability, and capacitance as a complementary quantity as $(\in(w/t))$ where $\in$ is the dielectric permittivity. Therefore, as the broadside capacitance for flat wire 502 increases due to a reduction of its insulation thickness t, the corresponding inductance component reduces proportionately, maintaining electromagnetic energy flow delay the same. Conversely, in a condition where the flat conductor within flat wire 502 is of smaller dimensions, while its insulation thickness is as designed, increased inductance to the shield due to a smaller width w of the flat conductor within flat wire 502 combines with the now reduced capacitance of flat wire 502 with respect to shield wrap 503 to render signal delay through flat wire 502 in the presence of shield wrap 503 about the same as in flat wire 501. Despite wire dimension differences, therefore, the regular, symmetric structure of invention drain wires and shield wrap design works toward equalized signal delay through individual flat wires of shielded flat pair 500, as opposed to prior art twisted pairs, where foil wrap shielding can amplify signal delay differences and impedance variations.

SFP's inherently approach a square aspect ratio for insulation materials employed with relative dielectric permittivity between 2 and 1.42, such as polyethylene and well-foamed polyethylene. At such relative dielectric permittivity and relative magnetic permeability of 1, the ratio of (s/w), the conductor separation to conductor width, varies between 0.75 and 0.63 respectively in order to maintain 100 ohms impedance for the shielded pair. The total height of the wire pair, given approximately by $2*(h+s)$, where h is the thickness of flat conductors used, is about the same as (w+s), the width of the SFP. For example, with separation 0.75 times width, the total width works out to be about 2⅓ times flat conductor separation, and the total height of the pair is 2 times the separation height added with twice the flat conductor thickness. In one embodiment, where flat conductor width is 0.5 mm and thickness 0.08 mm, SFP width is approximately 0.875 mm, and SFP height is 0.91 mm. With relative dielectric permittivity of flat wire insulation reduced to 1.42, SFP width is 0.815 mm and SFP height is 0.79 mm. For practical values of relative dielectric permittivity of flat wire insulation, therefore, SFP aspect ratio is approximately 1:1.

FIG. 2 illustrates a cable comprising four instances of the invention shielded flat pairs along with core and outer shield conductors. With reference to this figure, shielded flat pairs are placed and held in position orthogonally with respect to each other as taught by Nair [3]. For instance, SFP 203 is oriented within cable 200 in a manner such that its flat conductors are oriented at right angles to flat conductors of SFP 205 adjacent to it. In other words, an edge-side of SFP 203 faces a broadside of SFP 205. Crosstalk between SFP 203 and SFP 205, rendered largely harmless by this orthogonal relationship as taught by Nair [3], is additionally greatly diminished by the presence of a drain conductor and shield wrap on SFP 203's edge-side and the shield wrap on SFP 205's broadside that is adjacent to SFP 203's edge-side in the cable cross-section. Again, as taught in [3], a central wire or wires 204 provide additional isolation between diagonally situated SFP's. A snugly fitting cover 206, such as a thermally shrunk plastic cover, assists in retaining the orthogonal orientation of SFP's with respect to each other around a core wire or wires despite bending or twisting. An outer, conductive cover 202, such as an aluminum foil cover, combined with a metal braid constructed of tinned copper or steel conductors, provides a low-resistance outer shield that isolates SFP's from other cables. A plastic jacket 201 around this assembly completes this compact cable embodiment that instantiates invention shielded flat wire pairs. This embodiment of a cable employing SFP's demonstrates a square cross-section that can be advantageous in space-constrained applications. Additionally, the presence of an outer shield and core wires permits the transmission of electrical power through this cable embodiment, with the outer shield preferably connecting to system ground, and central core wire or wires connecting to a reference voltage.

A preferred cable embodiment of SFP's and multiple individual wires is illustrated in FIG. 3. With reference to this figure, co-axial wire pair separator 305 divides the cross-sectional area of cable 300 into four quadrants, each of which contains a SFP. SFP 303 is oriented and separated by separator 305 with respect to SFP 306, providing a further reduction in radiation coupling between the two shielded flat wire pairs. Wire pair separator 305 may be fabricated from highly conductive plastic material, such as that employed in anti-static applications, or may be coated with highly conductive paint, providing additional internal shielding of SFP's from each other. Separator 305 may also make electrically conductive connection at the ends of its four spokes to a highly conductive outer cable cover, such as a foil cover or metal braid, and may be connected to chassis or system ground through such connection. Separator 305 fabricated out of electrically conductive material or otherwise rendered electrically conductive, grounded in such manner, provides highly effective high-frequency electromagnetic isolation between SFP's within a cable. Cable 300 may include wires 304, which are insulated individual wires accompanying SFP's. As illustrated in FIG. 3, SFP's 303 and 306, insulated individual wires 304, separator 305, and outer conductive cover 302 may be designed to be of dimensions such that individual wires 304 remain immovably positioned adjacent to outer conductive cover 302 and separator 305 spokes. The square shape of SFP's 303 and 306 with their nearly 1:1 aspect ratio, combined with tightly wrapped outer conductive cover 302's circular shape prevent individual wires 304 from moving away from their designed positions adjacent to conductive cover 302 and separator spokes. With outer conductive cover 302, which may comprise of a metal braid in addition to a conductive foil wrap, connecting to system ground at either end of cable 300, individual wires 304 gain low-resistance electrical return current paths, and therefore demonstrate well-defined and unvarying impedance values throughout their length in cable 300. This character of individual wires 304 within invention cable embodiment 300 contrasts starkly with prior art cable assemblies, where indeterminate electromagnetic coupling of individual wires necessitates high-current signal drivers in order to encompass the entire range of capacitance variation of such prior art individual wires in a prior art cable assembly. Additionally, due to well-defined, adjacent, low-resistance current return paths for individual wires 304 in cable 300, electromagnetic radiation from these wires is greatly minimized. This aspect further reduces any signal coupling from individual wires 304 into SFP's 303, 306, etc. Cable jacket 301 completes assembly of invention cable embodiment 300.

FIG. 4 illustrates an alternate invention cable embodiment using SFP's. With reference to this figure, cable 400 contains a co-axial wire pair separator 405 whose cross-section comprises a central square shape with spoke arms emanating diagonally from the corners of said central square region. Wire separator 405 allows an alternate orthogonal arrangement of SFP's 403 and 406, providing increased distance between the central axes of SFP 403 and SFP 406 relative to SFP orientation in cable 300. Wire separator 405 may additionally be electrically conductive, and make electrically conductive connection at the end of its spoke arms to a conductive outer cover 402, providing enhanced isolation between SFP's within cable 400. Insulated single wires 404 accompanying SFP's in cable 400 are again situated adjacent to, and inseparable from conductive cover 402, providing benefits of well-defined and invariable impedance, and low emissions from these wires. Additionally, in cable 400, individual wires 404 are symmetrically located at the edge-sides of SFP's, where the presence of drain conductors within SFP's minimize any signal coupling into SFP's. Cable 400 may include central or core wire or wires 407 that may be employed for the conduction of reference or power signals, further enhancing isolation between SFP's. With a conductive co-axial separator, such core wire may also be shielded, providing an isolated central co-axial cable within the larger cable embodiment, enhancing cable bandwidth. An optical fiber with cladding may be used in place of a core electrical wire in this cable embodiment, greatly enhancing bandwidth of the cable. Cable jacket 401 completes assembly of invention cable embodiment 400.

Inventor believes flat wire pairs to be a natural first step toward higher bandwidth interconnect of the future, such as parallel plate waveguides, and, eventually, dielectric ribbons and optical fibers. This belief is supported by known ultra-high (terahertz) frequency capabilities of parallel plate waveguides, which are very similar in structure to flat wire pairs, and by practical benefits of flat wire pairs facilitating high-frequency signal transmission. For instance, skin-effect losses at high frequencies are diminished by as much as 38.5% in a 0.5×0.08 mm flat wire equivalent of an AWG 31 wire of 0.227 mm diameter, since the perimeter of a 0.5 mm by 0.080 mm flat conductor of 1.16 mm is proportionately greater than the 0.713 mm perimeter of the AWG 31 round conductor. Lower skin-effect resistance of flat conductors at high frequencies as well as relatively constant values of wire inductance and capacitance (through invariant charge flow regions and relative dielectric permittivity approaching 1 of air or vacuum) facilitates meeting the Oliver Heaviside relation (R/L=G/C) and practical realization of dispersion-free wire pairs. Again, for instance, series resistance for a 0.5×0.08 mm flat conductor of copper, at 5 GHz and a skin depth of approximately 0.9 um, works out to (by $R_{1\delta}/\pi$, where $R_{1\delta}$ is the resistance of a layer of thickness equal to one skin depth for the conductor, and $\pi$ is the pythagorean constant) approximately 12 ohms per meter per conductor, or 24 ohms per meter considering the matched return signal flow path. From the Heaviside relation, we obtain ($R_s/L=(1/R_pC)$), where $G=1/R_p$, which leads to $R_p=(Z^2/R_s)$, where Z is the transmission line characteristic impedance (SQRT(L/C)). For a desired characteristic impedance of 100 Ohms, we find that the non-ideal parallel resistance to wire pair capacitance leading to material dependent loss, $R_p$, computes approximately to 416 Ohms per meter. At 5 GHz, with C of 60 pF/m, this corresponds to a Tan-δ or dissipation factor of $(1/(2\pi f R_p C))=0.0013$. One skilled in the art will recognize that this value of dissipation factor is within practical, realizable values for typical dielectric material, and that the Heaviside relation for a dispersion-less transmission line may be satisfiable for flat wire pairs at particular frequencies of interest. Additionally, lower series resistance $R_s$ (and correspondingly higher $R_P$) reduces attenuation through flat wire pairs, further enhancing signal integrity at the far end of a cable. These aspects of flat wire pairs lend support to the belief that such wire-pair structure is the transition step toward terahertz interconnect of the future.

Although specific embodiments are illustrated and described herein, any component arrangement configured to achieve the same purposes and advantages may be substituted in place of the specific embodiments disclosed. This disclosure is intended to cover any and all adaptations or variations of the embodiments of the invention provided herein. All the descriptions provided in the specification have been made in an illustrative sense and should in no manner be interpreted in any restrictive sense. The scope, of various embodiments of the invention whether described or not, includes any other applications in which the structures, concepts and methods of the invention may be applied. The scope of the various embodiments of the invention should therefore be determined with reference to the appended claims, along with the full range of equivalents to which such claims are entitled. Similarly, the abstract of this disclosure, provided in compliance with 37 CFR §1.72(b), is submitted with the understanding that it will not be interpreted to be limiting the scope or meaning of the claims made herein. While various concepts and methods of the invention are grouped together into a single 'best-mode' implementation in the detailed description, it should be appreciated that inventive subject matter lies in less than all features of any disclosed embodiment, and as the claims incorporated herein indicate, each claim is to be viewed as standing on its own as a preferred embodiment of the invention.

What is claimed is:

1. A shielded wire pair, comprising:

Two insulated, flat wires, with substantially rectangular conductors with rounded edges and conformal insulation coatings forming parallel surfaces, bonded together with broad, flat, parallel surfaces of said flat wires abutted against each other over their length, forming a flat wire pair;

two uninsulated wires of substantially circular cross-section, with one of the two uninsulated wires placed within a first groove formed between said conformal insulation coatings of said flat wires on a first edge side of the flat wire pair, and another of the two uninsulated wires placed within a second groove formed between said conformal insulation coatings of said flat wires on a second, opposite, edge side, said uninsulated wires of length equal to said flat wires and of diameter larger than a depth of said grooves;

and a taut, close fitting conductive wrap around the flat wire pair and uninsulated round wires along their length, said conductive wrap conforming to broad, flat, outer surfaces of the flat wire pair, making physical and electrical contact with the two uninsulated wires, and creating cross-section air gaps between its conductive surface and insulation surfaces on said edge sides of the flat wire pair.

2. The shielded flat pair of claim 1 where said flat conductors are coated with silver providing smooth surfaces of sub-micrometer surface height variation.

3. The shielded flat pair of claim 1 where said flat conductors are coated with graphene nanoribbon layers on their broad surfaces closest to and facing each other in the wire pair.

4. The shielded flat pair of claim 1 where the conductive wrap is coated with gold providing sub-micrometer surface height variation on said wrap's conductive surface.

5. A cable comprising: four of said shielded flat wire pairs of claim 1, wherein the wire pairs are placed in close proximity to each other within the cable with said flat conductors of one of said shielded wire pairs oriented orthogonal to said flat conductors of an adjacent one of said shielded wire pairs.

6. The cable of claim 5 further comprising a snugly fitting outer cover holding said shielded wire pairs in their orientation with respect to each other.

7. The cable of claim 6 further comprising a central, coaxial, insulated core wire, and a highly conductive, flexible outer sheath.

8. The cable of claim 7 having a substantially square cross-sectional area.

9. The cable of claim 8 further comprising an outer jacket of flexible, insulating material.

10. Electronic systems and cables transmitting electronic signals with high frequency components beyond a gigahertz employing the wire pair of claim 1.

11. A cable of circular cross-section, comprising:

A plurality of wire pairs of substantially square cross-section, a central coaxial separator, insulated single wires, and an electrically conductive outer cover;

wherein the central coaxial separator divides a cross-section of said cable into identical sectors, wherein one of said plurality of wire pairs of substantially square cross-section and two of said insulated single wires are in each of said sectors;

and wherein each of the two insulated single wires in each sector is held in close proximity to said conductive outer cover between said one wire pair of substantially square cross-section in the sector and a central coaxial separator surface bounding the sector.

12. The cable of claim 11 where the central coaxial separator is electrically conductive and makes electrical contact with said conductive outer cover along a length of said cable.

13. The cable of claim 12 where the central coaxial separator is fabricated using flexible material mixed with an electrically conductive substance rendering said central separator electrically conductive.

14. The cable of claim 12 where the central coaxial separator is fabricated using flexible material and is coated with an electrically conductive substance rendering it conductive.

15. The cable of claim 11 employing shielded flat wire pairs of substantially square cross-section and insulated single wires have substantially round cross-section.

16. The cable of claim 11 where the co-axial separator has a square central cross-section with sides of dimension sufficient to seat a side of said wire pairs of substantially square cross-section.

17. The cable of claim 16 where said insulated single wires are held against the conductive outer cover of the cable and the central co-axial separator by sides of said wire pairs.

18. The cable of claim 11 where the co-axial separator includes a central, co-axial insulated electrical wire.

19. The cable of claim 11 where the co-axial separator includes a central, co-axial optical fiber with cladding.

20. Electronic systems and cables transmitting a plurality of electronic signals employing the cable of claim 11.

* * * * *